US006755611B1

(12) United States Patent
Kabasawa et al.

(10) Patent No.: US 6,755,611 B1
(45) Date of Patent: Jun. 29, 2004

(54) VACUUM PUMP

(75) Inventors: Takashi Kabasawa, Narashino (JP); Manabu Nonaka, Narashino (JP); Takashi Okada, Narashino (JP)

(73) Assignee: BOC Edwards Japan Limited, Tokyo (JP)

( * ) Notice: Subject to any disclaimer, the term of this patent is extended or adjusted under 35 U.S.C. 154(b) by 182 days.

(21) Appl. No.: 09/572,745

(22) Filed: May 16, 2000

(30) Foreign Application Priority Data

May 28, 1999 (JP) ..... 11-149097

(51) Int. Cl.[7] ..... F01D 1/36
(52) U.S. Cl. ..... 415/90
(58) Field of Search ..... 415/90

(56) References Cited

U.S. PATENT DOCUMENTS 3,157,793 A * 11/1964 Adkins ..... 415/90
4,411,135 A * 10/1983 Striebich ..... 415/90
5,059,092 A * 10/1991 Kabelitz et al. ..... 415/90
5,553,998 A * 9/1996 Muhlhoff et al. ..... 415/90
5,577,883 A * 11/1996 Schutz et al. ..... 415/90
6,106,223 A * 8/2000 Leyshon ..... 415/90
6,179,573 B1 * 1/2001 Hablanian ..... 415/90

* cited by examiner

*Primary Examiner*—John Kwon
(74) *Attorney, Agent, or Firm*—Adams & Wilks

(57) ABSTRACT

A vacuum pump has a casing having an interior space, an inlet port for introducing gas molecules into the interior space, and an outlet port for discharging the gas molecules from the interior space. A rotor shaft extends into the interior space of the casing for undergoing rotation about a rotational axis. A stator is connected to the casing and has stator blades extending into the interior space of the casing. A rotor is disposed between the casing and the rotor shaft. The rotor has a preselected number of rotor blades disposed at an uppermost stage thereof and alternately disposed between the stator blades for undergoing rotation with the rotor shaft to direct gas molecules toward the outlet port. A rotational member is disposed between the inlet port and the rotor for undergoing rotation with the rotor shaft about the rotational axis. The rotational member has a generally conical-shaped surface gradually decreasing toward the inlet port. Guiding blades are disposed on the conical-shaped surface of the rotational member for undergoing rotation with the rotational member about the rotational axis to impart movement to the gas molecules in the interior space of the casing in a radial direction relative to the rotational axis.

20 Claims, 14 Drawing Sheets

VACUUM PUMP

BACKGROUND OF THE INVENTION

1. Field of the Invention

The present invention relates to a vacuum pump and, more specifically, to a vacuum pump with blades for discharging gas molecules arranged on an inlet port side of the vacuum pump.

2. Description of the Related Art

Vacuum pumps are widely used in, for example, a device for discharging a gas in a chamber of an apparatus for manufacturing semiconductors to thereby bring the chamber into a vacuum state. Among these vacuum pumps, there are ones composed only of blades, ones composed of a combination of a blade portion and a screw groove portion, etc.

FIGS. 12 and 13 illustrate the structure of a conventional vacuum pump. FIG. 12 is a diagram showing a part of the top view of the pump, and FIG. 13 is a diagram showing a part of the section thereof.

This vacuum pump is provided with stator blades 50 fixed to a casing 10 that has an inlet port 16, and a rotor 41 having rotor blades 40 that are rotated while being fixed to a rotating rotor shaft 18. The respective stator blades 50 and the rotor blades 40 are arranged in the axial direction in multi-stages, and constitute an exhaust system 13 for taking from the inlet port 16 gas molecules A into a space between the rotor 41 and the casing 10 to discharge the gas molecules A.

Such vacuum pump accomplishes vacuumizing (exhaustion) by rotating with a motor the rotor shaft 18 at a high speed of ten to ninety thousand rpm under the normal state.

There is known a measure in which the outer diameter of the rotor blades 40 is increased in order to increase the peripheral speed of the rotor blades 40 and enhance the discharging ability. However, this causes a decrease in rigidity of the rotor blades 40, and hence the measure also includes enlargement of the inner diameter of the rotor blades 40. Due to this structure, while the gas molecules A enter with the same extent that the inlet port 16 has, the flow of the gas molecules A is interrupted in a dead space defined by the inner diameter of the uppermost stage of the rotor blades 40 facing the inlet port 16 (a space around the top of the rotor shaft 18) where there are no blades. The existence of this dead space is practically equivalent to a lowering of the effective area of the inlet port, which reduces the conductance as well as the amount of gas molecules entering into spaces between the rotor blades 40. This leads to a problem of decreased exhaust efficiency.

As countermeasures against that dead space in the center of the inlet port, there is proposed a vacuum pump in which a conic inducer 19 is attached to the upper end of the rotor shaft 18 as shown in FIG. 14. This proposed pump can give an outward motion component in radial direction to the gas molecules A that collide against the wall surface of the inducer 19.

However, the gas molecules A in a molecule flow region obey the law of cosines to head off in the normal direction with respect to the collision face, as shown in FIG. 14, and thus gains not only the outward motion component but also the upward (in the direction of the inlet port) motion component, resulting in an insufficient exhaust efficiency.

SUMMARY OF THE INVENTION

The present invention has been made to solve the above problems that the conventional vacuum pumps suffer from and, therefore, an object of the present invention is to provide a vacuum pump with enhanced exhaust efficiency achieved by increasing the amount of gas molecules that enter into spaces between rotor blades.

The present invention attains the above object through a vacuum pump comprising: a casing with an inlet port; a rotor shaft housed in the casing; an exhaust means arranged between the rotor shaft and the casing such that it can rotate together with the rotor shaft, the exhaust means discharging gas molecules, which are taken in through the inlet port, by rotating along with the rotation of the rotor shaft; and guiding blades arranged between the rotor shaft and the inlet port such that it can rotate together with the rotor shaft, the guiding blades imparting an outward motion component in radial direction to the gas molecules, which are taken in through the inlet port, by rotating along with the rotation of the rotor shaft.

According to the present invention, the guiding blades are formed on a forming surface that is formed into a conic shape the diameter of which is gradually decreased toward the inlet port.

According to the present invention, the guiding blades are formed such that the front thereof in the rotation direction is perpendicular to the forming surface.

According to the present invention, the guiding blades are formed such that the front thereof in the rotation direction is sloped down to the rear rotation direction with respect to the radial direction with the axis of rotation as its center.

According to the present invention, the exhaust means comprises at least a plurality of blades, and the number of the guiding blades is set by multiplying the number of rotor blades, which are arranged in the uppermost stage of the above plurality of blades, by its divisor or by an integer.

According to the present invention, the guiding blades are formed at positions corresponding to a casing's decreased diameter portion on a casing inner wall the diameter of which is gradually decreased toward the inlet port.

According to the present invention, the exhaust means comprises a blade portion or a screw groove portion, or comprises a combination of the blade portion and the screw groove portion.

DETAILED DESCRIPTION OF THE PREFERRED EMBODIMENTS

Hereinbelow a description will be given in detail of preferred embodiments of the present invention with reference to the drawings.

Figure 1:
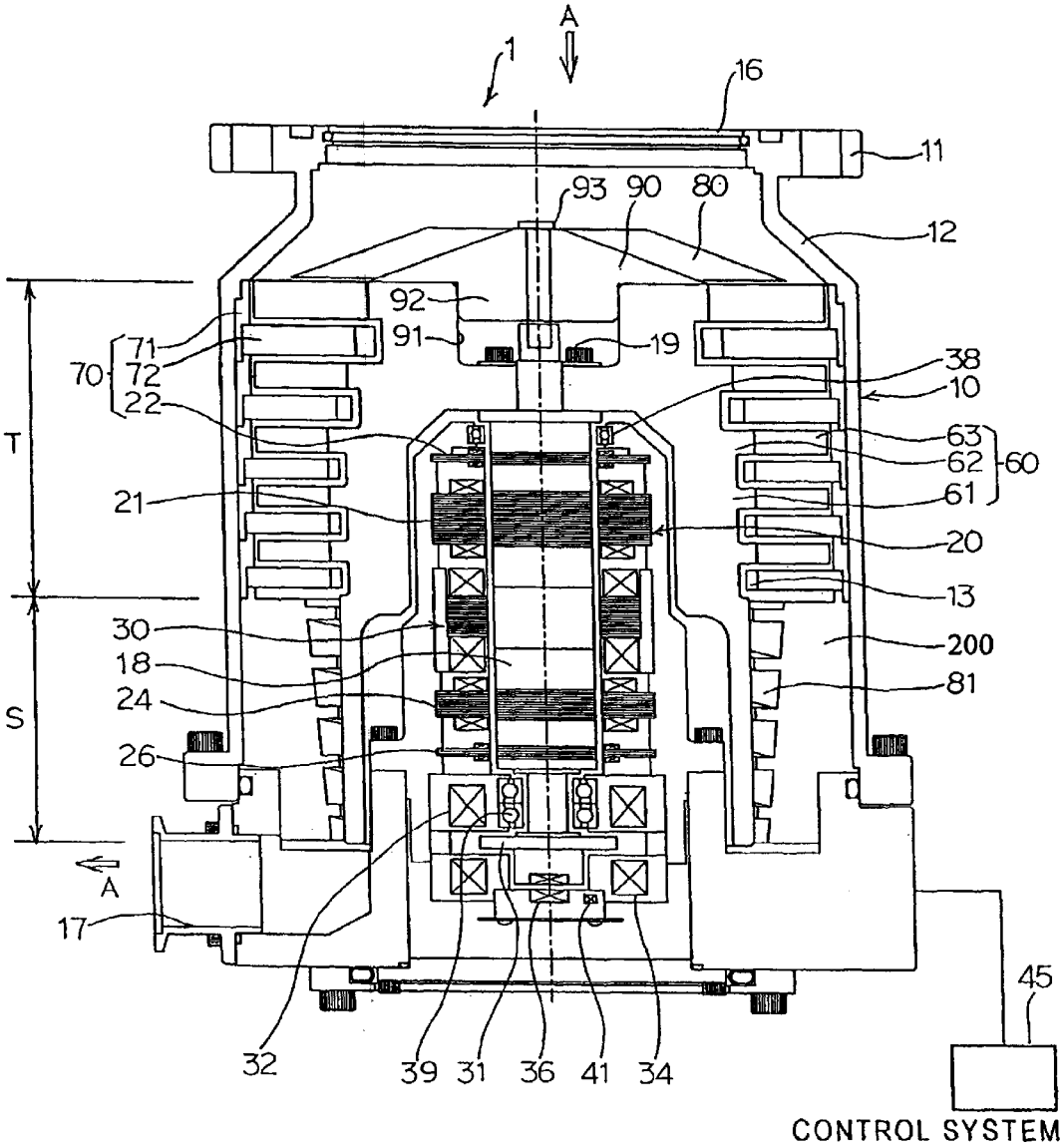
FIG. 1 is a sectional view showing a vacuum pump according to an embodiment of the present invention.

FIG. 1 is a diagram showing in section the whole structure of a vacuum pump according to an embodiment of the present invention.

This vacuum pump denoted by reference numeral 1 is installed in, for example, an apparatus for manufacturing semiconductors and discharges process gas from a chamber or the like. The vacuum pump 1 is provided with a turbomolecular pump unit T and a screw groove pump unit S, the unit T transferring the process gas from the chamber or the like downstream with stator blades 72 and rotor blades 62, the unit S transferring further the process gas from the unit T with a screw groove pump to discharge the gas.

As shown in FIG. 1, the vacuum pump comprises a cylindrical casing 10, a columnar rotor shaft 18 arranged in the center of the casing 10, a rotor 60 that is fixedly placed on the rotor shaft 18 and rotates along with the rotor shaft 18, and a stator 70.

The casing 10 has at its upper end a flange 11 elongated outward in the radial direction. This flange 11 is fastened to the apparatus for manufacturing semiconductors or the like with, for example, a bolt to connect an inlet port 16 formed inside the flange 11 to an outlet port of a vessel, e.g., the chamber, so that the interior of the vessel is communicated with the interior of the casing 10.

The rotor 60 includes a rotor body 61 shaped like an inverted letter U and arranged on the outer periphery of the rotor shaft 18. This rotor body 61 is attached to the top of the rotor shaft 18 with bolts 19. In the turbomolecular pump unit T, the rotor body 61 has multi-stages of rotor blades 62 formed on its outer periphery. The rotor blades are a plurality of blades which are open on the outer side.

The stator 70 is provided with, in the turbomolecular pump unit T, spacers 71 and stator blades 72 that are arranged between the respective stages of the rotor blades 62 while each of the stator blades is supported on its outer periphery side between two adjacent spacers 71. In the screw groove pump unit S, the stator 70 is provided with screw groove portion spacers 200 that are formed as a continuation of the spacers 71.

The spacers 71 have a cylindrical shape with a stepped portion and are stacked inside the casing 10. The length in the axial direction of the stepped portion positioned on the inner side of each of the spacers 71 is determined in accordance with the interval between two adjacent rotor blades 62.

The screw groove portion spacers 200 are arranged inside the casing 10 and are formed, as a continuation of the spacers 71, below the spacers 71 and the stator blades 72. The screw groove portion spacers 200 have such a thickness that their inner diameter walls jetty to the extent that the walls are close to the outer peripheral surface of the rotor body 61. A helical screw groove 81 with plural threads is formed on the inner diameter walls of the spacers 200. The screw groove 81 is communicated with a path between the stator blades 72 and the rotor blades 62, and gas transferred through the path between the stator blades 72 and the rotor blades 62 is introduced into the screw groove 81 and is further transferred through the screw groove 81 by the rotation of the rotor body 61.

Although the screw groove 81 is formed on the stator 70 side in this embodiment, the screw groove 81 may be formed on the outer diameter wall of the rotor body 61. Alternatively, the screw groove 81 may be formed both on the screw groove portion spacers 200 and on the outer diameter wall of the rotor body 61.

The vacuum pump 1 further comprises a magnetic bearing 20 for supporting the rotor shaft 18 by a magnetic force and a motor 30 for generating a torque in the rotor shaft 18.

The magnetic bearing 20 is a 5-axes-control type magnetic bearing, and is provided with: radial electromagnets 21, 24 for generating a magnetic force in the radial direction of the rotor shaft 18; radial sensors 22, 26 for detecting the position of the rotor shaft 18 in the radial direction; axial electromagnets 32, 34 for generating a magnetic force in the axial direction of the rotor shaft 18; an armature disc 31 upon which the magnetic force in the axial direction, generated by the axial electromagnets 32, 34, acts; and an axial sensor 36 for detecting the position of the rotor shaft 18 in the axial direction.

The radial electromagnets 21 include two pairs of electromagnets arranged such that one pair is perpendicular to the other pair. The electromagnets in each pair are arranged at positions above the motor 30 on the rotor shaft 18 so as to face one another with the rotor shaft 18 interposed between two of the electromagnets.

Above the radial electromagnets 21, two pairs of radial sensors 22 are arranged such that two sensors in each pair faces one another with the rotor shaft 18 interposed therebetween. Two pairs of the radial sensors 22 are arranged so that one pair is perpendicular to the other, corresponding to two pairs of radial electromagnets 21.

At positions below the motor 30 on the rotor shaft 18, two pairs of the radial electromagnets 24 are similarly arranged so that one pair is perpendicular to the other pair.

Below the radial electromagnets 24, similarly, two pairs of the radial sensors 26 are arranged adjacent to the radial electromagnets 24.

An excitation current is supplied to these radial electromagnets 21, 24 to float the rotor shaft 18 with a magnetic force. The control of the excitation current is made, when the shaft is floated with a magnetic force, in response to position detection signals sent from the radial sensors 22, 26, to thereby keep the rotor shaft 18 at a predetermined position in the radial direction.

The armature disc 31 made of a magnetic member and shaped like a disc is fixed to a lower part of the rotor shaft 18. A pair of axial electromagnets 32 and a pair of axial electromagnets 34 are also arranged on a lower part of the rotor shaft 18, one electromagnet facing its counterpart with the armature disc 31 interposed therebetween. The axial sensor 36 is arranged on the lower end of the rotor shaft 18.

The excitation current flowing through the axial electromagnets 32, 34 is controlled in response to a position detection signal sent from the axial sensor 36, to thereby keep the rotor shaft 18 at a predetermined position in the axial direction.

The magnetic bearing 20 is provided with a not-shown magnetic bearing control unit as a control system 45. The magnetic bearing control unit feedback-controls the excitation current flowing through the radial electromagnets 21, 24 and the axial electromagnets 32, 34 on the basis of detection signals sent from the radial sensors 22, 26 and a detection signal sent from the axial sensor 36, respectively, thereby floating the rotor shaft 18 with a magnetic force.

In this way, it is possible for the vacuum pump 1 according to this embodiment to be driven in a clean environment, for the employment of the magnetic bearing eliminates any mechanical contacts to produce no dust, and dispenses the pump of oils such as a sealing oil to generate no gas. The vacuum pump as such is suitable for an application in which a high cleanness is required as in manufacture of semiconductors.

The vacuum pump 1 according to this embodiment also has touch down bearings 38, 39 arranged on an upper part and on a lower part of the rotor shaft 18, respectively.

Usually, the rotor unit comprising the rotor shaft 18 and the parts attached to the shaft is, while being rotated by the motor 30, axially supported by the magnetic bearing 20 without coming into contact with the bearing. The touch down bearings 38, 39 are bearings for protecting the entire pump by axially supporting the rotor unit instead of the magnetic bearing 20 when the touch down takes place.

Accordingly, the touch down bearings 38, 39 are arranged so that their inner rings do not come into contact with the rotor shaft 18.

The motor 30 is arranged almost in the middle between the radial sensors 22 and 26, inside the casing 10, in the axial direction of the rotor shaft 18. The motor 30 is energized to rotate the rotor shaft 18 as well as the rotor 60 and the rotor blades 62, which are attached to the shaft. The number of revolutions thereof is detected by a revolution sensor 41, and the rotation is controlled by the control system on the basis of a signal from the revolution sensor 41.

An outlet port 17 for discharging to the outside the air transferred from the screw groove pump unit S is arranged in a lower part of the casing 10 of the vacuum pump 1.

The vacuum pump 1 is connected to the control system through a connector and a cable.

What is special to the present invention is that, as shown in FIG. 1, guiding blades 80 for imparting, to the gas molecules A taken in from the inlet port 16, an outward motion component in the radial direction and toward the entrance of the exhaust system 13 are integrally attached to the upper end of the rotor 60. The guiding blades 80 are formed to be integrated with the rotor 60 or, alternatively, are formed of separate pieces that are separate from the rotor 60. The example illustrated in FIG. 1 shows the guiding blades 80 formed of the separate pieces.

To be specific, the guiding blades 80 are formed on a conic boss portion 90 whose diameter is gradually reduced toward the inlet port 16, so that the guiding blades 80 rotate, through the boss portion, in unison with the rotor 60 in the same direction that the rotor 60 rotates. An engagement groove 91 open to the inlet port 16 is formed on the rotor body 61, and an engagement projection 92 for engaging with the engagement groove 91 is formed on the bottom of the boss portion 90 so as to project on the rotor body 61 side. A bolt 93 is inserted through the boss portion 90 and is screwed into the upper end of the rotor shaft 18, to thereby fix the guiding blades 80 including the boss portion 90 to the rotor body 61.

An outward motion component in the radial direction is thus imparted to the gas molecules A taken in from the inlet port 16 and drawn into the upstream to the rotor 60 by the guiding blades 80 that rotates in unison with the rotor 60. As a result, the gas molecules A are forcedly guided to the entrance of the exhaust system 13. The gas molecules entered into the exhaust system are therefore increased in number, enhancing the exhaust efficiency of the exhaust system 13.

Figure 2:
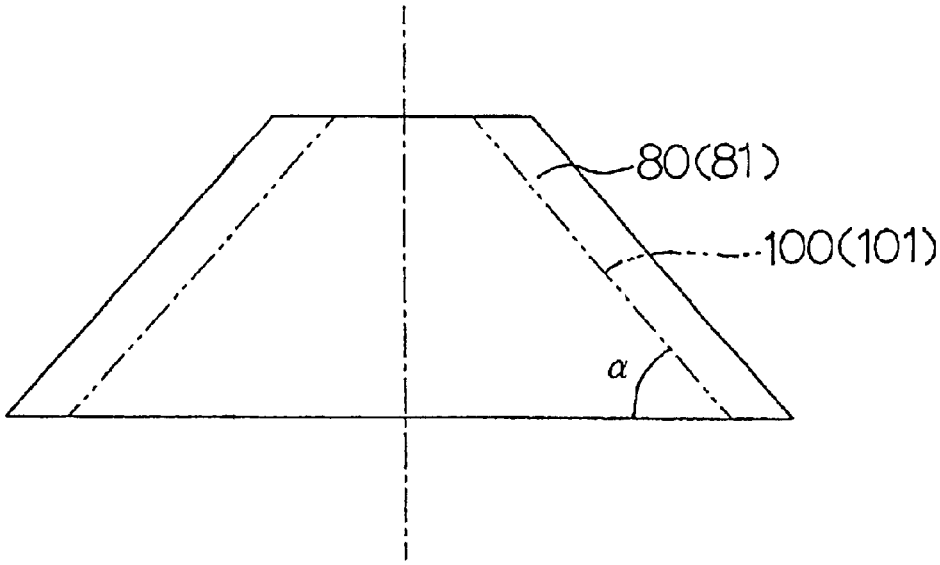
FIG. 2 is a diagram showing a forming surface of the present invention.
Figure 3:
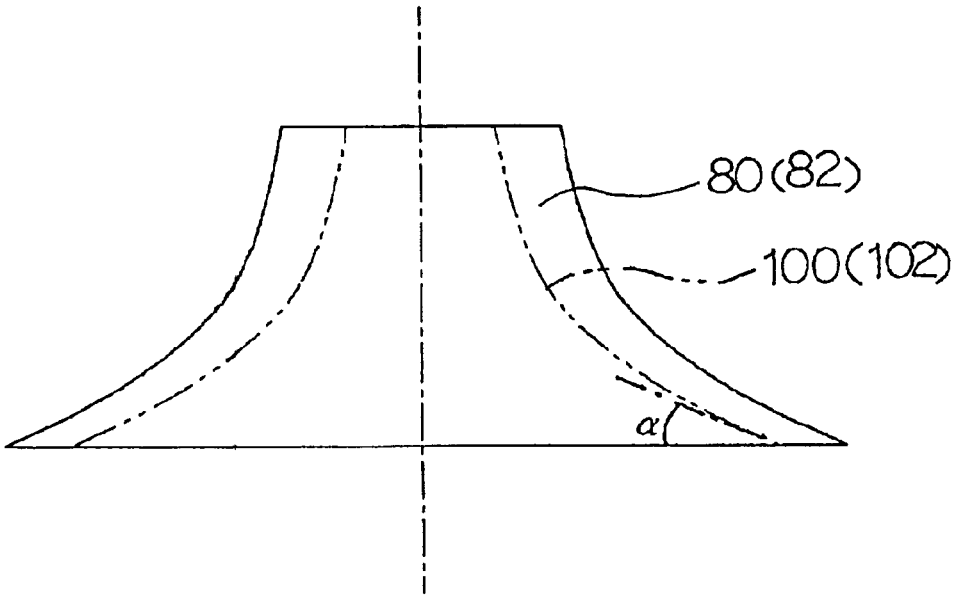
FIG. 3 is a diagram showing another forming surface of the present invention.
Figure 4:
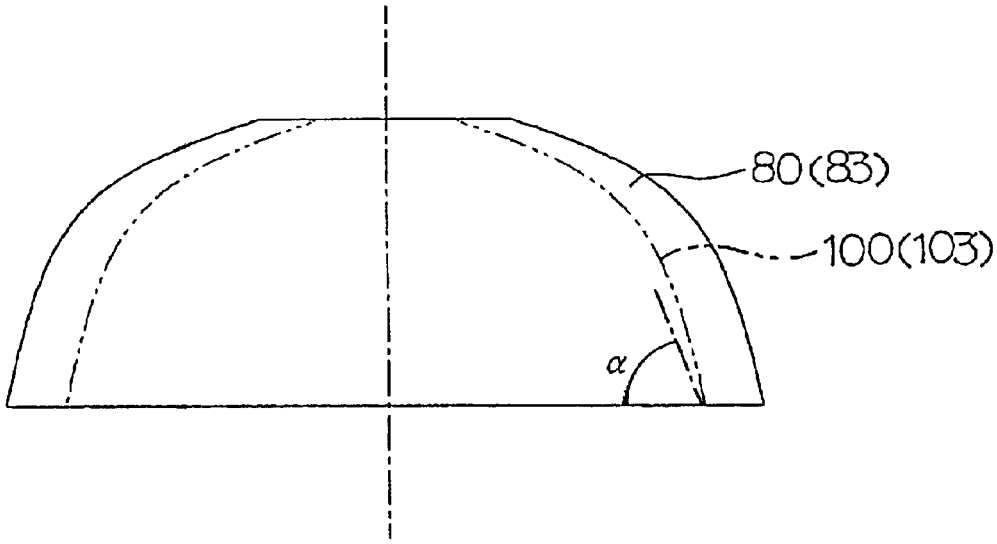
FIG. 4 is a diagram showing still another forming surface of the present invention.

FIGS. 2, 3, 4 illustrate a rotational member having a forming surface 100 on which the guiding blades 80 are formed according to other embodiments of the invention. The forming surface 100 in each drawing is formed into a conic shape whose diameter is gradually decreased toward the inlet port 16.

More specifically, shown in FIG. 2 is a forming surface 101 formed into a conic shape that is trapezoid in section and is decreased in diameter linearly from the downstream side to the upstream side. Shown in FIG. 3 is an example in which a forming surface 102 formed into a conic shape whose diameter is decreased in the radial direction inwardly. FIG. 4 shows a forming surface 103 formed into a conic shape that is increased in diameter in the radial direction outwardly, i.e., larger diameter on the downstream side, and is semicircular in section.

Guiding blades 81, 82, 83 each have an angle of elevation in accordance with the diameter of the conic shapes of the forming surfaces 101, 102, 103.

The peripheral speed is increased as the distance from the axis of rotation is increased from the upstream side to the downstream side in any of the forming surfaces 101, 102, 103. Therefore, when an outward motion component in the radial direction is imparted, a reflection speed distribution of the gas molecules A which has a shape similar to the shape of the forming surface 101, 102 or 103 is obtained, increasing the amount of gas entered into the exhaust system 13. In order to increase the number of the gas molecules entered into the exhaust system 13, it is desirable to, for example, set $\alpha$ base angle a of the forming surface to 15 to 60°.

Figure 5:
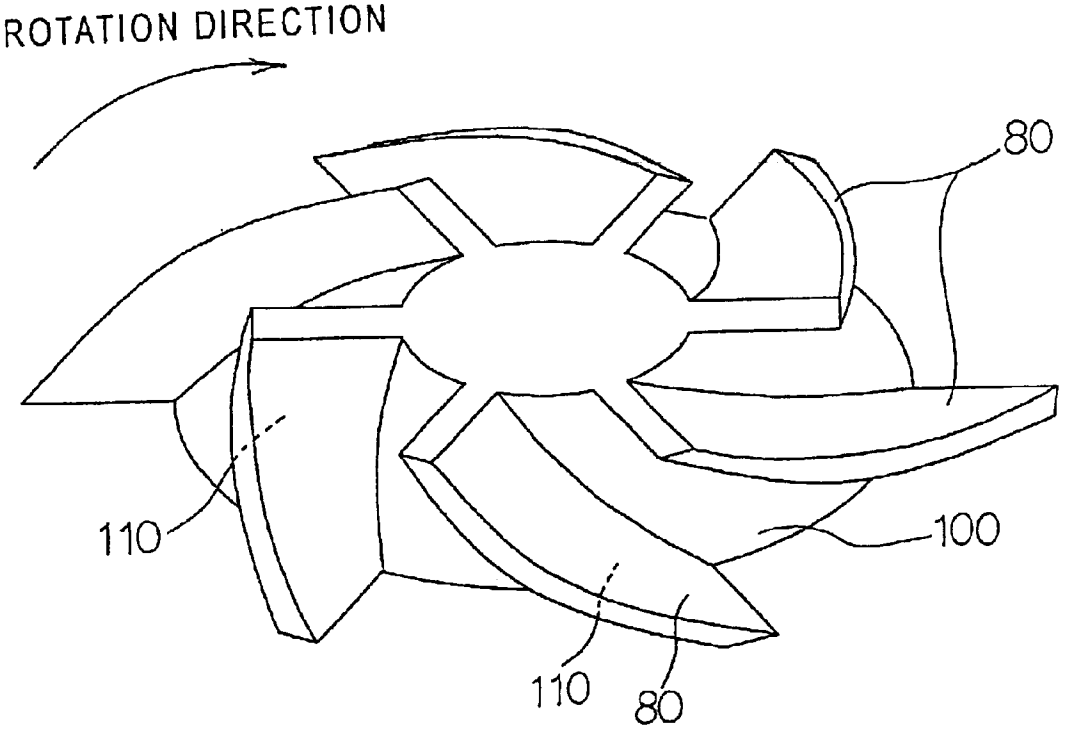
FIG. 5 is a perspective view showing guiding blades and a forming surface of the present invention.

In FIG. 5, the guiding blades 80 are formed on the forming surface 100 formed into a conic shape along the periphery thereof with equal gaps, and each of the guiding blades 80 has a reflecting surface 110 for reflecting the gas molecules A on its front in the rotation direction.

Figure 6:
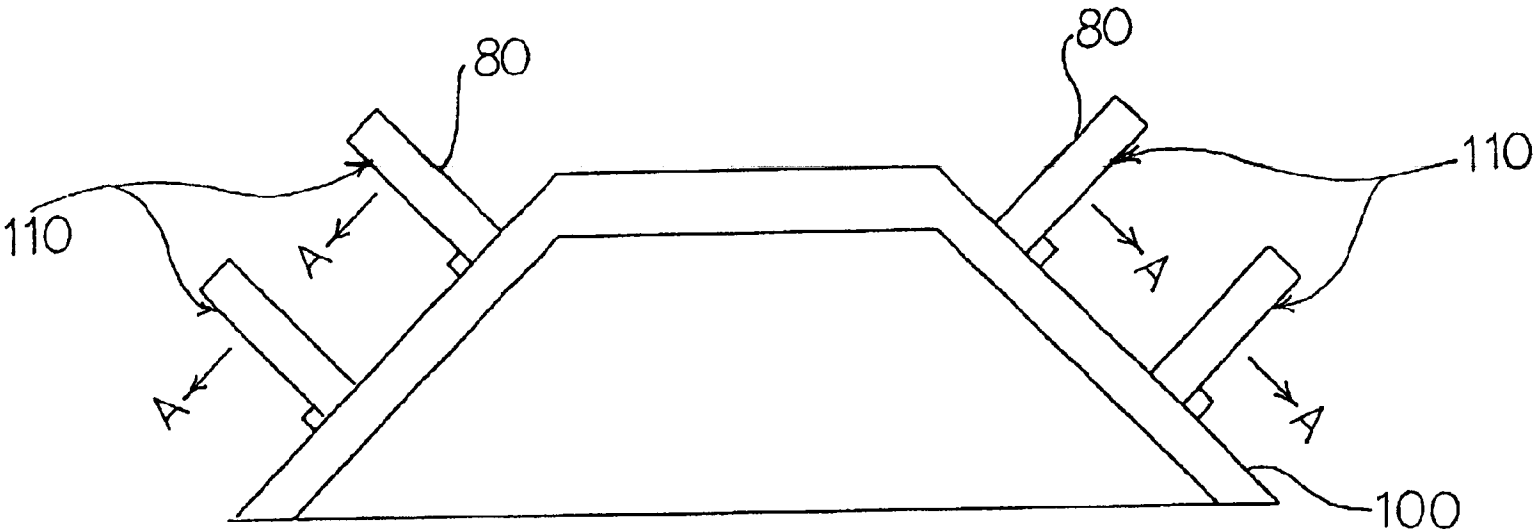
FIG. 6 is a sectional view showing the guiding blades.
Figure 8:
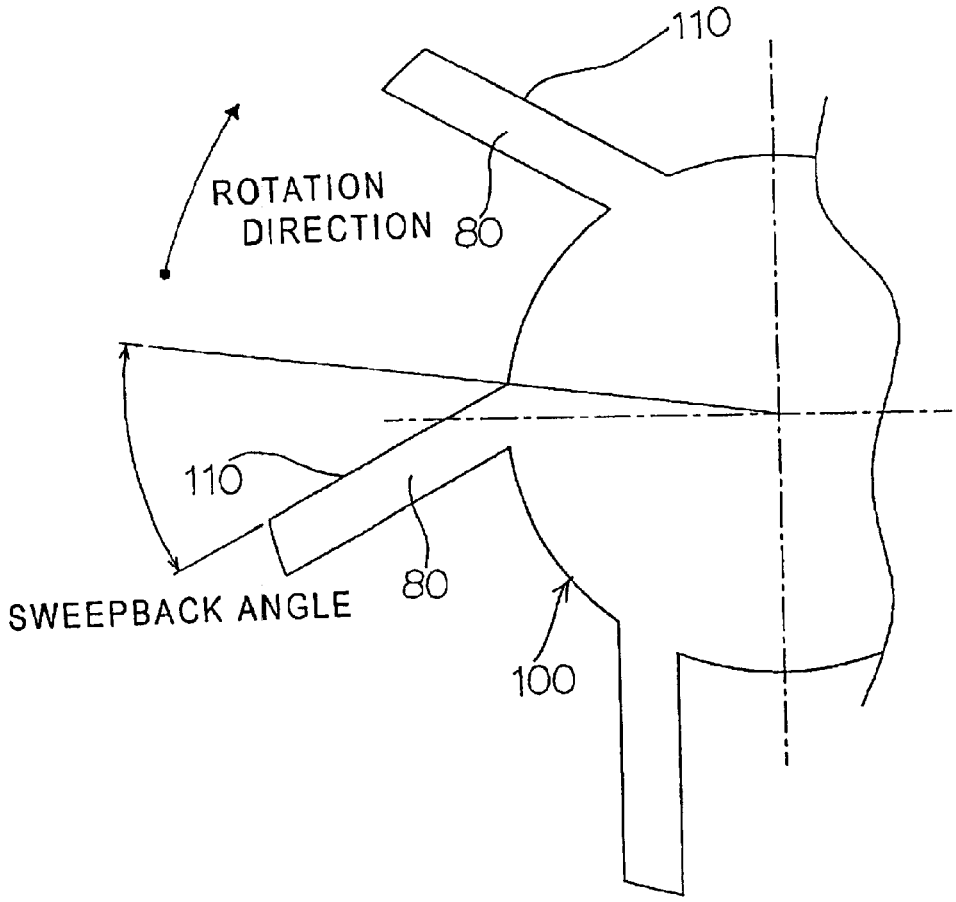
FIG. 8 is a sectional plan view showing guiding blades.
Figure 9:
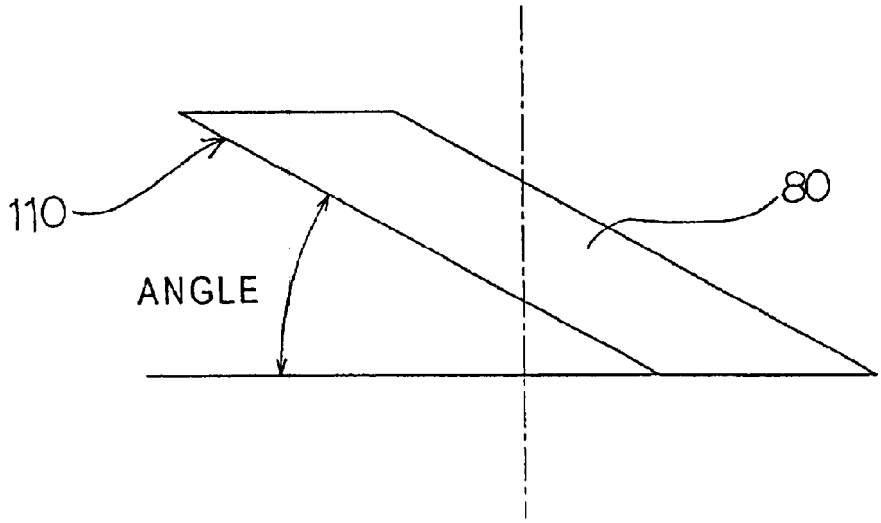
FIG. 9 is an enlarged view showing an angle of elevation of the guiding blades.

This reflecting surface 110 is formed so as to stand vertically to the forming surface 100 and is sloped down to the rear rotation direction with respect to the radial direction of the forming surface 100 with the axis of rotation as its center. FIGS. 6, 8, 9 are enlarged views each showing an important part of the guiding blades 80 and the reflecting surface 110 formed on each of the blades 80.

As described above, the gas molecules A are reflected vertically by the wall surface from the law of cosines in the molecule flow region. Therefore, when the reflecting surface is formed perpendicular to the forming surface 100 as shown in FIG. 6, the gas molecules A can be reflected outward in the radial direction and toward the downstream (axial direction opposite to the inlet port 16) without colliding against the forming surface 100.

Figure 7:
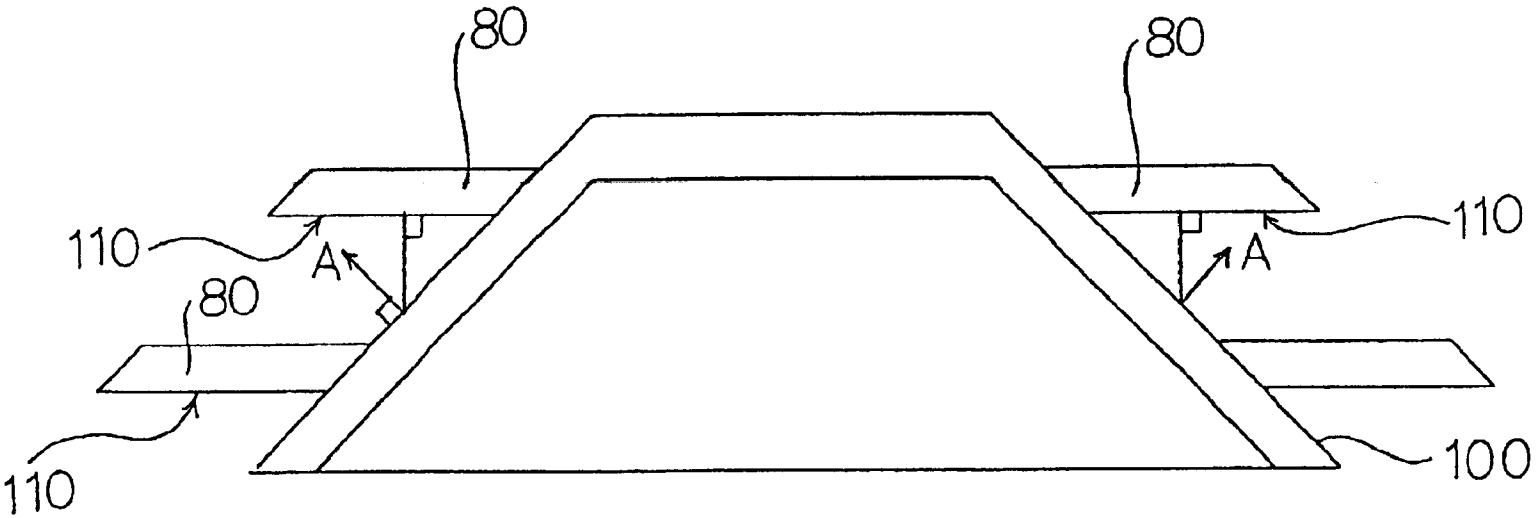
FIG. 7 is a sectional view showing an example in which a reflecting surface is attached at an acute angle to the forming surface.

That is, when the reflecting surface 110 is formed so as to slant to the forming surface 100 at an acute angle as shown in FIG. 7, the gas molecules A reflected by the reflecting surface 110 is collided with the forming surface 100, and further is vertically reflected by the forming surface 100. This makes it difficult to give the gas molecules A an outward motion component in the radial direction.

As shown in FIGS. 5, 8, 9, the reflecting surface 110 is formed so as to slope down to the rear rotation direction at a given sweepback angle with respect to the radial direction of the forming surface 100 with the axis of rotation as its center. This sets the front of the guiding blades 80 outward in the radial direction, making it possible to give the gas molecules A a larger outward motion component in the radial direction.

The reflecting surface 110 formed on each of the guiding blades 80 has an angle of elevation of 15 to 60° with respect to the axial section cut at the right angle, as shown in FIGS. 5, 6, 8, 9.

In this way, the number of the guiding blades 80 formed on the forming surface 100 along the periphery thereof in the rotation direction with equal gaps is set to a number obtained by multiplying the number of blades in the uppermost stage of the rotor 60 by its divisor or by an integer. Setting the number of the guiding blades 80 to such a number, the gas molecules A collide against the top surface of the rotor blades 62, i.e., a surface facing the inlet port 16 at a lower rate, to thereby prevent the backward flow of the gas molecules A.

Furthermore, as shown in FIG. 1, the reflecting surface 110 is formed in the surface opposite to the guiding blades 80 at a position along the height of the casing's reduced diameter portion 12 where the inner wall of the casing is gradually decreased in diameter toward the inlet port 16. Also the molecules collided with the casing are thus reflected toward the exhaust system 13, increasing even more the amount of the gas molecules entered into the exhaust system 13 and enhancing the exhaust efficiency.

Figure 10:
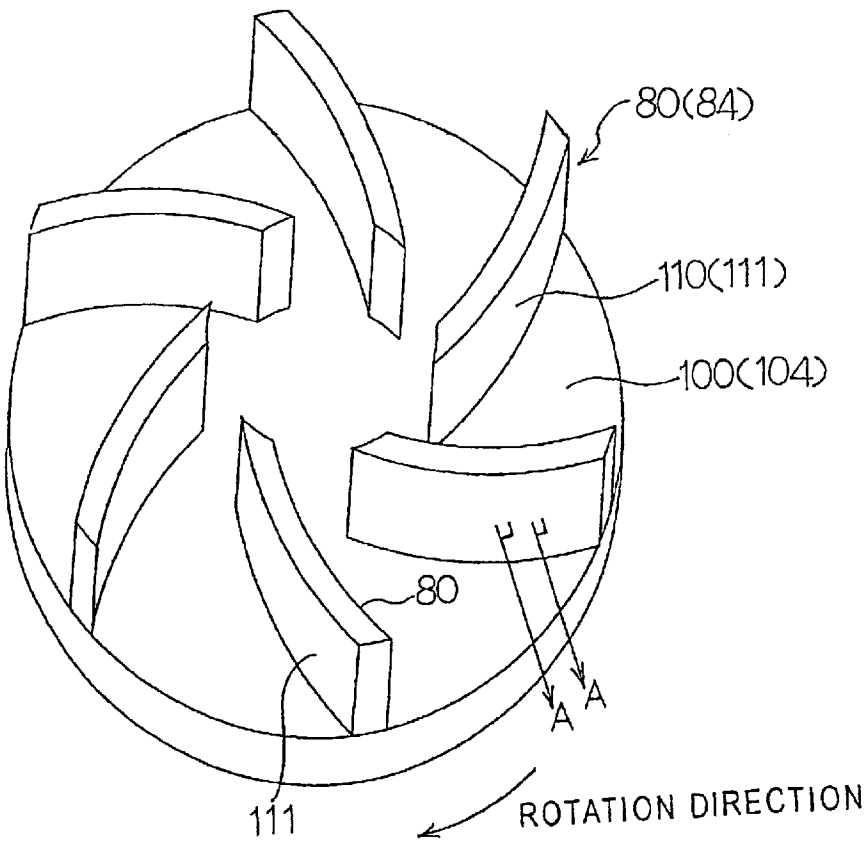
FIG. 10 is a perspective view showing another embodiment of the present invention.
Figure 11:
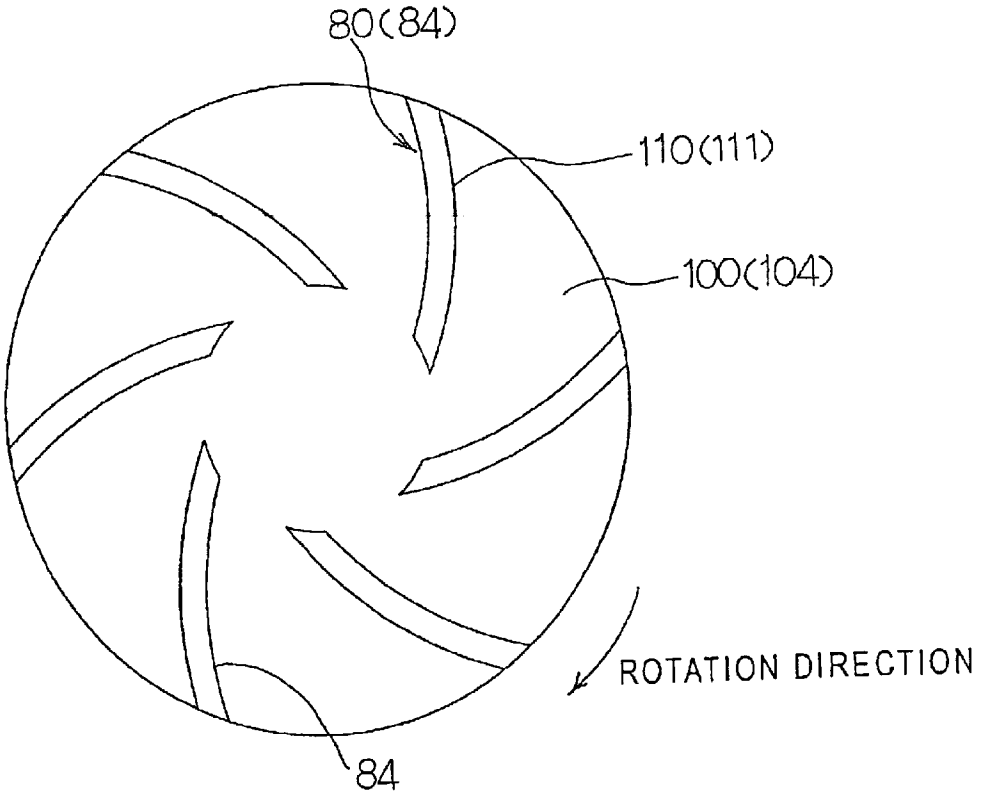
FIG. 11 is a plan view showing the embodiment illustrated in FIG. 10.
Figure 12:
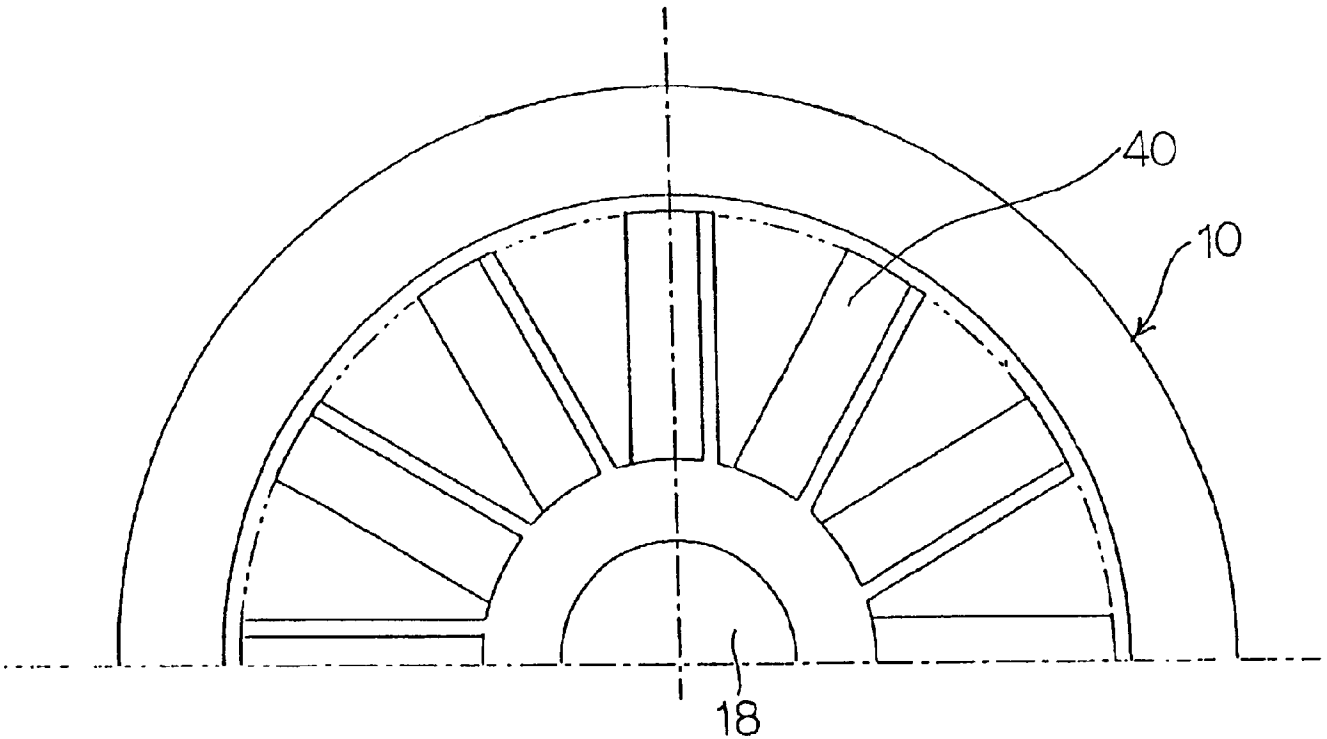
FIG. 12 PRIOR ART
FIG. 12 is a plan view showing a conventional vacuum pump.
Figure 13:
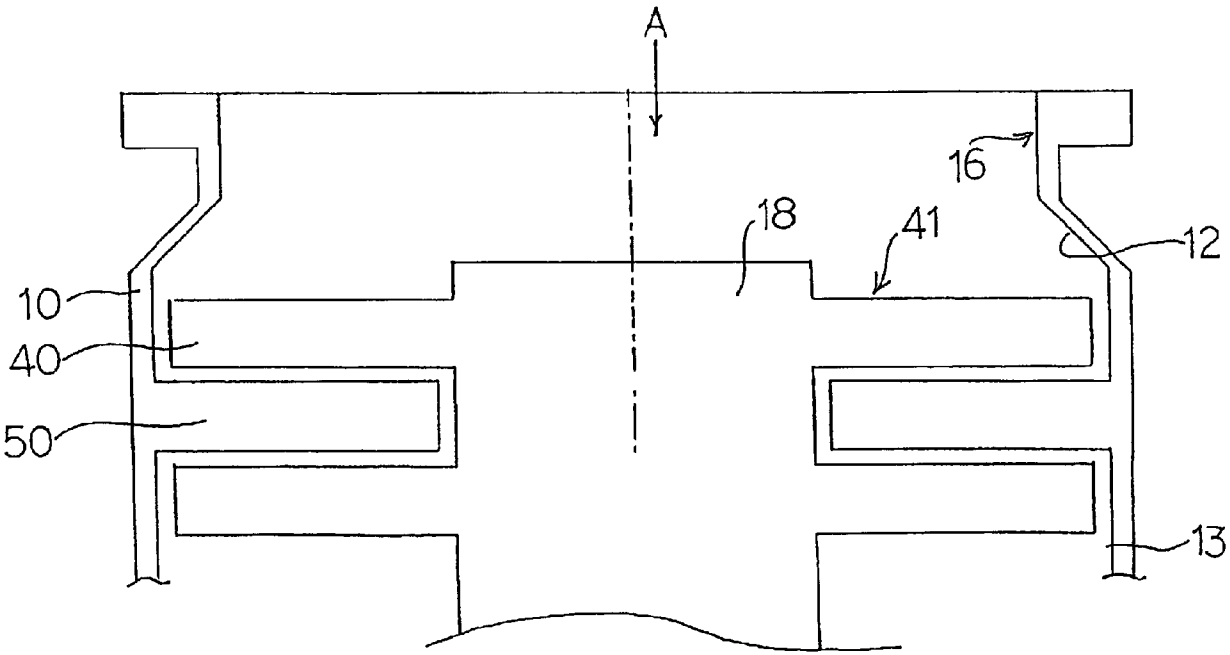
FIG. 13 PRIOR ART
FIG. 13 is a vertical sectional view showing the conventional vacuum pump.
Figure 14:
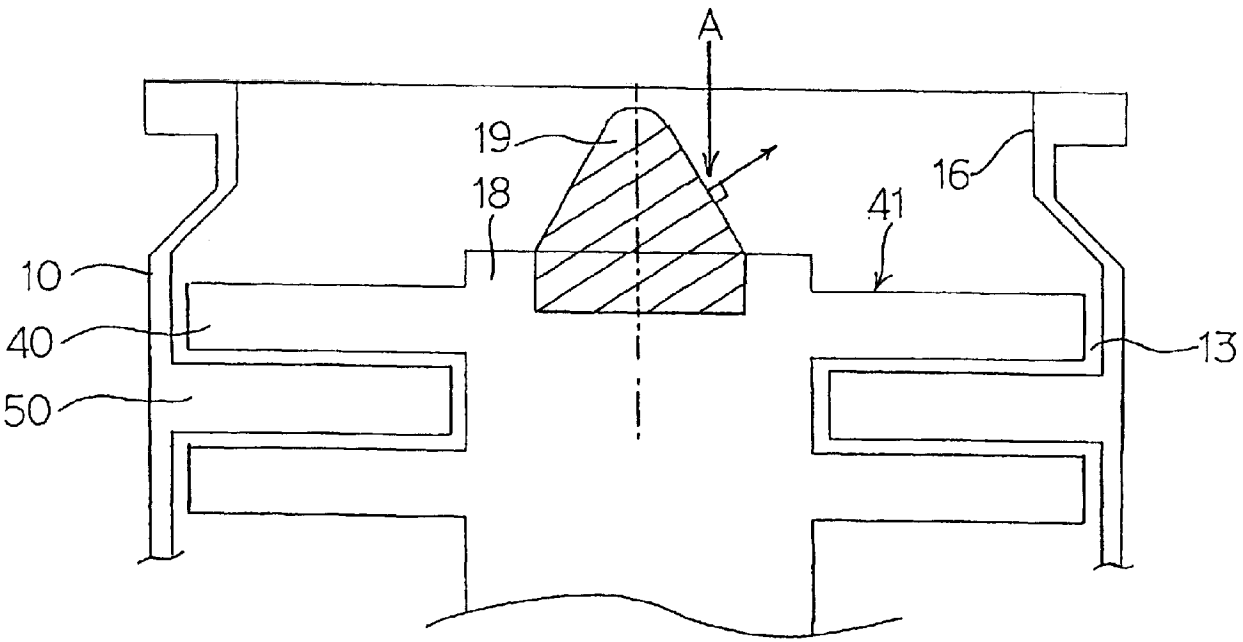
FIG.14 PRIOR ART
FIG. 14 is a vertical sectional view showing another conventional vacuum pump.

FIGS. 10 and 11 illustrate the reflecting surface 110 and the guiding blades 80 on which the reflecting surface is formed according to another embodiment of the invention. A reflecting surface 111 formed on each of guiding blades 84 stands vertically on a forming surface 104 that is disk-like and flat, and is gradually sloped down to the rear rotation direction with respect to the radial direction of the forming surface 104 with the axis of rotation as its center. Accordingly, the gas molecules A are vertically reflected by the reflecting surface 111 to be given with a motion component outward to the tangential direction. This increases the amount of gas molecules entered into the exhaust system 13 to enhance the exhaust efficiency, as in the previous embodiment.

As has been described in the above, the following effects can be obtained through the vacuum pump according to this embodiment:

(1) The guiding blades for imparting an outward motion component in the radial direction to gas molecules are attached to the upper end of the rotor unit, thereby increasing the amount of gas molecules entered into the exhaust system and enhancing the exhaust efficiency.

(2) The guiding blades are formed on the forming surface that is formed into a conic shape, thereby increasing the amount of gas molecules entered into the exhaust system and enhancing the exhaust efficiency.

(3) The reflecting surface of the guiding blades is formed so as to vertically stand on the forming surface, thereby imparting the gas molecules an outward motion component in the radial direction and increasing the amount of gas molecules entered into the exhaust system.

(4) The reflecting surface of the guiding blades is sloped down to the rear rotation direction with respect to the radial direction, thereby imparting a large outward motion component in the radial direction.

(5) The number of the guiding blades is set by multiplying the number of rotor blades in the uppermost stage of the rotor unit by its divisor or by an integer, thereby preventing the gas molecules from flowing backwards from the exhaust system to the upstream side.

(6) The casing is reduced in diameter on the surface opposite to the guiding blades, thereby increasing even more the amount of gas molecules entered into the exhaust system and enhancing the exhaust efficiency.

In conclusion, according to the present invention, the guiding blades are attached between the rotor shaft and the inlet port which rotate with the rotor shaft to impart an outward motion component in the radial direction to the gas molecules taken in from the inlet port. Thus the gas molecules from the inlet port can be efficiently guided to the exhaust means, enhancing the exhaust efficiency.

What is claimed is:

1. A vacuum pump comprising:

a casing having an inlet port and an inner wall portion gradually decreasing in diameter toward the inlet port;

a rotor shaft mounted in the casing for undergoing rotation in a rotational direction about a rotational axis;

exhaust means disposed between the rotor shaft and the casing for undergoing rotation with the rotor shaft about the rotational axis to discharge gas molecules which are taken in through the inlet port of the casing;

a rotational member disposed between the inlet port and the exhaust means and mounted for undergoing rotation with the rotor shaft about the rotational axis, the rotational member having a generally conical-shaped surface gradually decreasing toward the inlet port; and a plurality of guiding blades disposed on the conical shaped surface of the rotational member for undergoing rotation with the rotational member about the rotational axis to impart an outward motion component in a radial direction to the gas molecules which are taken in through the inlet port, the guiding blades being disposed in the casing at a position corresponding to a space in the casing surrounded by the inner wall portion thereof.

2. A vacuum pump as claimed in claim 1; wherein each of the guiding blades has a front end portion disposed generally perpendicular to the conical-shaped surface of the rotational member.

3. A vacuum pump as claimed in claim 1; wherein each of the guiding blades has a front end portion extending radially from the rotational axis and sloping down in a direction opposite to the rotational direction.

4. A vacuum pump according to claim 3; wherein the conical-shaped surface of the rotational member has a base angle in the range of 15° to 60° relative to an axis perpendicular to the rotational axis.

5. A vacuum pump as claimed in claim 1; wherein the exhaust means comprises a plurality of blades having a preselected number of rotor blades disposed at an uppermost stage thereof; and wherein the number of the guiding blades is a preselected number obtained by multiplying the preselected number of the rotor blades by its divisor or by an integer.

6. A vacuum pump as claimed in claim 1; wherein the exhaust means comprises a blade portion.

7. A vacuum pump as claimed in claim 1; wherein the exhaust means comprises a screw groove portion.

8. A vacuum pump as claimed in claim 1; wherein the exhaust means comprises a blade portion and a screw groove portion.

9. A vacuum pump as claimed in claim 1; wherein the exhaust means comprises a plurality of blades.

10. A vacuum pump according to claim 1; wherein the conical-shaped surface of the rotational member has a base angle in the range of 15° to 60° relative to an axis perpendicular to the rotational axis.

11. A vacuum pump according to claim 1; wherein each of the guiding blades has a reflecting surface for reflecting gas molecules, the reflecting surface being disposed at a preselected angle to the conical-shaped surface of the rotational member so that gas molecules reflected by the reflecting surface do not collide with the conical-shaped surface.

12. A vacuum pump according to claim 2; wherein the conical-shaped surface of the rotational member has a base angle in the range of 15° to 60° relative to an axis perpendicular to the rotational axis.

13. A vacuum pump comprising:

a casing having an interior space, an inlet port for introducing gas molecules into the interior space, an outlet port for discharging the gas molecules from the interior space, and an inner wall portion gradually decreasing in diameter toward the inlet port;

a rotor shaft extending into the interior space of the casing for undergoing rotation about a rotational axis;

a stator connected to the casing and having a plurality of stator blades extending into the interior space of the casing;

a rotor disposed between the casing and the rotor shaft, the rotor having a preselected number of rotor blades disposed at an uppermost stage thereof and alternately disposed between the stator blades for undergoing rotation with the rotor shaft to direct gas molecules toward the outlet port;

a rotational member disposed between the inlet port and the rotor for undergoing rotation with the rotor shaft about the rotational axis, the rotational member having a generally conical-shaped surface gradually decreasing toward the inlet port; and a plurality of guiding blades disposed on the conical-shaped surface of the rotational member for undergoing rotation with the rotational member about the rotational axis to impart movement to the gas molecules in the interior space of the casing in a radial direction relative to the rotational axis, the guiding blades being disposed in the casing at a position corresponding to a portion of the interior space of the casing surrounded by the inner wall portion thereof.

14. A vacuum pump according to claim 13; wherein the conical-shaped surface of the rotational member has a base angle in the range of 15° to 60° relative to an axis perpendicular to the rotational axis.

15. A vacuum pump according to claim 13; wherein each of the guiding blades has a reflecting surface for reflecting gas molecules in the interior space of the casing during rotation of the rotational member, the reflecting surface being disposed at a preselected angle to the conical-shaped surface of the rotational member so that gas molecules reflected by the reflecting surface do not collide with the conical-shaped surface.

16. A vacuum pump according to claim 13; wherein the reflecting surface of each of the guiding blades is disposed generally perpendicular to the conical-shaped surface of the rotational member.

17. A vacuum pump as claimed in claim 13; wherein each of the guiding blades has a reflecting surface for reflecting gas molecules in the interior space of the casing during rotation of the rotational member, the reflecting surface extending in a radial direction relative to the rotational axis and sloping down in a direction opposite to a rotational direction of the rotor shaft.

18. A vacuum pump as claimed in claim 13; wherein the number of guiding blades is a preselected number obtained by multiplying the preselected number of the rotor blades by its divisor or by an integer.

19. A vacuum pump comprising:

a casing having an inlet port;

a rotor shaft mounted in the casing for undergoing rotation in a rotational direction about a rotational axis;

exhaust means disposed between the rotor shaft and the casing for undergoing rotation with the rotor shaft about the rotational axis to discharge gas molecules which are taken in through the inlet port of the casing, the exhaust means having a preselected number of rotor blades disposed at an uppermost stage thereof;

a generally disk-shaped rotational member having a planar surface and disposed between the inlet port and the exhaust means and mounted for undergoing rotation with the rotor shaft about the rotational axis; and a plurality of guiding blades disposed on the planar surface of the rotational member for undergoing rotation with the rotational member about the rotational axis to impart an outward motion component in a radial direction to the gas molecules which are taken in through the inlet port, the number of guiding blades being a preselected number obtained by multiplying the preselected number of the rotor blades by its divisor or by an integer.

20. A vacuum pump as claimed in claim 19; wherein each of the guiding blades has a front end portion disposed generally perpendicular to the planar surface of the rotational member.

* * * * *